US005191378A

United States Patent [19]

Itaya et al.

[11] Patent Number: 5,191,378

[45] Date of Patent: Mar. 2, 1993

[54] ELECTROSTATIC RECORDING APPARATUS IN WHICH A TRANSFER MATERIAL CONVEYANCE BELT DETACH POINT IS LOCATED DOWNSTREAM FROM THE IMAGE RETAINER

[75] Inventors: Masahiko Itaya; Hisahiro Saito; Takayuki Miyamoto, all of Hachioji, Japan

[73] Assignee: Konica Corporation, Tokyo, Japan

[21] Appl. No.: 557,167

[22] Filed: Jul. 23, 1990

[30] Foreign Application Priority Data

Jul. 31, 1989 [JP] Japan ..... 1-199088

[51] Int. Cl.[5] ..... G03G 15/16

[52] U.S. Cl. ..... 355/274; 355/277

[58] Field of Search ..... 355/274, 277, 275, 271

[56] References Cited

U.S. PATENT DOCUMENTS 4,407,580 10/1983 Hashimoto et al. ..... 355/275

4,515,460 5/1985 Knechtel ..... 355/327

4,796,047 1/1989 Fowlkes et al. ..... 355/277

4,958,194 9/1990 Kaieda et al. ..... 355/277

FOREIGN PATENT DOCUMENTS 0120442 10/1978 Japan ..... 355/275

*Primary Examiner*—A. T. Grimley

*Assistant Examiner*—Christopher Horgan

*Attorney, Agent, or Firm*—Jordan B. Bierman

[57] ABSTRACT

An electrostatic recording apparatus having a transfer separation unit of a belt-roller transfer system wherein an endless-form transfer material conveyance belt is attached to a toner image retainer by an electrode roller and detached from the toner image retainer on the downstream side of the attached plane. A transfer material is passed through a gap between the transfer material conveyance belt and the electrode roller so that the toner image on the toner image retainer be transferred onto the transfer material.

1 Claim, 2 Drawing Sheets

ELECTROSTATIC RECORDING APPARATUS IN WHICH A TRANSFER MATERIAL CONVEYANCE BELT DETACH POINT IS LOCATED DOWNSTREAM FROM THE IMAGE RETAINER

BACKGROUND OF THE INVENTION

1. Field of the Invention

The present invention relates to an electrostatic recording apparatus for which a belt-roller transfer system is adapted to transfer a toner image from a toner image retainer onto a transfer material.

2. Description of the Prior Art

In a recording (reproducing) process of an electrophotographic system, corona discharge of a direct current or an alternating current has usually been used for transfer/separation in almost all cases. This is probably because a relatively stable performance is obtained by a simple structure under the limited conditions of the quantity of sticking toner, a change in environment and a transfer material (paper for transfer).

However, the application of the usual transfer system has limitations in a process wherein about three times as much quantity of toner as usual needs to be transferred as in the case of toner, such as magnetic toner, which has high dependence on the environment in transfer, or in the case of color copying.

Accordingly, a belt transfer system has been studied and examined heretofore, and this system has been regarded as enabling the attainment of a high performance theoretically.

There are few examples of its practical application, however, due to technical problems and the problem of the cost accompanying this system. A system using a belt of high resistance and a corona discharge electrode can be cited as the example of said system having been put to practical use. However, a strict control on the occurrence of ozone has been requested recently and therefore a system not using corona discharge is desired.

In order to meet this demand, the present inventor has developed a transfer separation unit of a belt-roller transfer system, wherein an endless-form transfer material conveyance belt is pressed toward a photosensitive member by an electrode roller and a transfer material is made to proceed between this transfer material conveyance belt and the electrode roller so that a toner image on the photosensitive member be transferred onto the transfer material.

In this belt-roller transfer system, however, it has been difficult to detach reliably from the photosensitive member the transfer material whereon the toner image is transferred.

SUMMARY OF THE INVENTION

An object of the present invention is to furnish an electrostatic recording apparatus having such a transfer separation unit that enables the solution of these problems.

In an electrostatic recording apparatus having a transfer separation unit of a belt-roller transfer system wherein an endless-form transfer material conveyance belt is pressed toward a toner image retainer by an electrode roller and a transfer material is made to proceed between the aforesaid transfer material conveyance belt and the aforesaid electrode roller so that a toner image on the aforesaid toner image retainer be transferred onto the aforesaid transfer material, a point whereat the aforesaid transfer material conveyance belt is detached from the aforesaid toner image retainer is provided on the downstream side of a nip plane formed by the aforesaid transfer material conveyance belt, which is pressed by the aforesaid electrode roller, and by the aforesaid toner image retainer, according to the present invention, so as to attain the aforesaid object.

Other objects and characteristics of the present invention will be described hereunder with drawings.

DESCRIPTION OF THE PREFERRED EMBODIMENT

Figure 1:
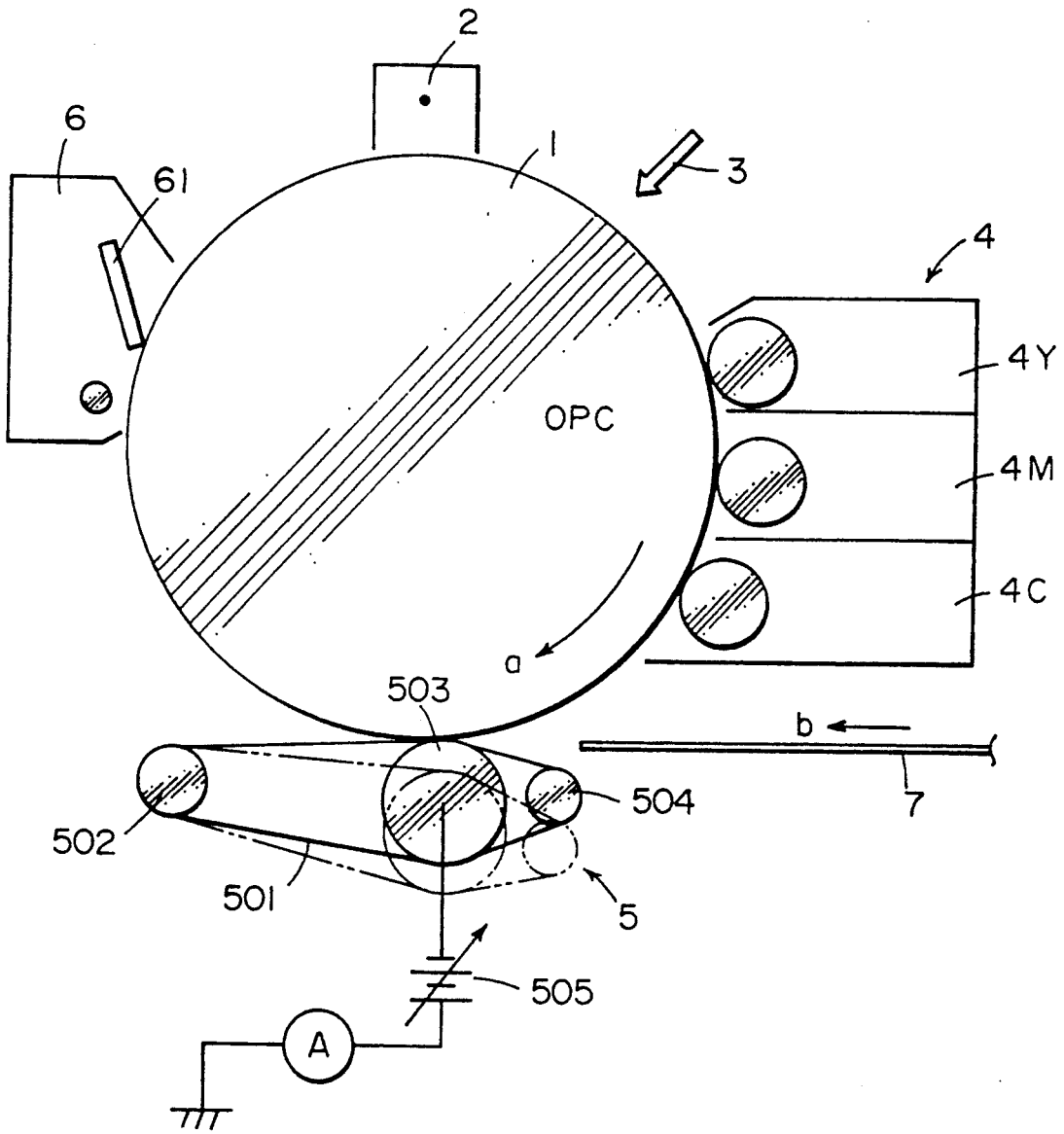
FIG. 1 is a schematic structural view of an electrostatic recording apparatus of one embodiment of the present invention.

The following is a description on an embodiment of the present invention. FIG. 1 is an illustration of a schematic construction of an electrostatic recording apparatus which is one embodiment thereof. In the figure, numeral 1 denotes a photosensitive member as a toner image retainer, 2 a charging electrode, 3 a laser light bearing an image information, 4 a developing unit having a yellow toner developing device 4Y, a magenta toner developing device 4M and a cyan toner developing device 4C, 5 a transfer separation unit, and 6 a cleaning unit.

While the photosensitive member 1 charged with electricity of high voltage by the charging electrode 2 rotates in the direction of an arrow a in this electrostatic recording apparatus, the photosensitive surface thereof is exposed by the laser light 3. Thereby an electrostatic latent image is formed thereon and this image is developed by one selected developing device in the developing unit 4. When the laser exposure and the development are performed three times in total for a yellow image, a magenta image and a cyan image while the photosensitive member 1 rotates three times, a toner image of three superposed colors of yellow, magenta and cyan is formed on the surface of the photosensitive member 1. During these operations, the transfer separation unit 5 and the cleaning unit 6 are detached from the photosensitive member 1. After the three-color toner image is formed on the photosensitive member 1 as described above, the transfer separation unit 5 is pressed on the photosensitive member 1 and the three-color toner image is transferred onto a transfer material (paper) 7 fed at a prescribed timing from the direction of an arrow b. The transfer material 7 whereon this three-color toner is transferred is subjected to fixation by a thermal fixation unit not shown in the figure, and then it is delivered outside. As to the cleaning unit 6, a blade 61 thereof is brought into contact with the surface of the photosensitive member 1 as well after the aforesaid three-color toner image is formed, so as to remove the toner remaining on the surface of the photosensitive member 1 after the three-color toner is transferred on the transfer material 7.

Figure 2:
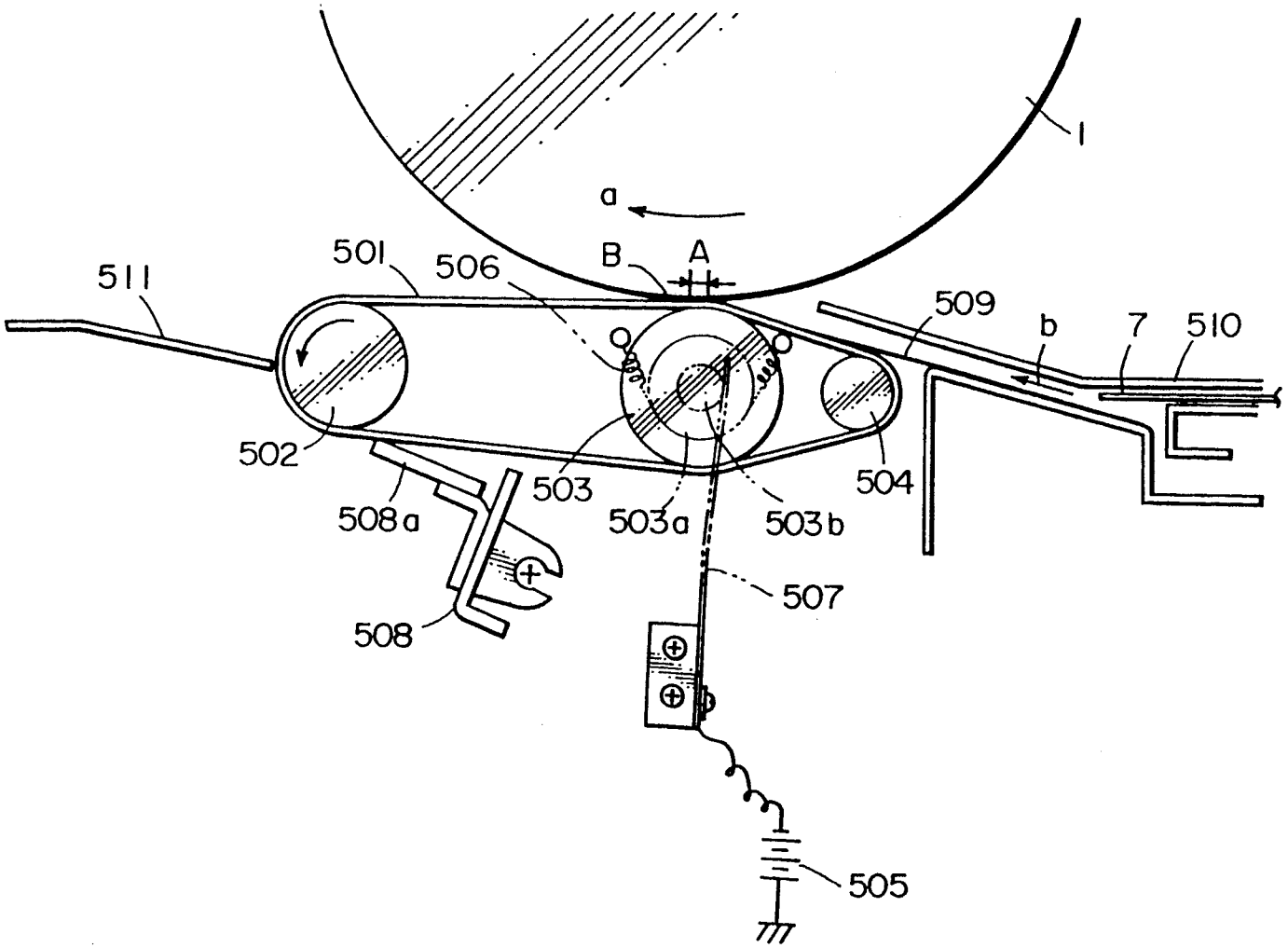
FIG. 2 is an illustration of a concrete construction of a transfer separation unit.

FIG. 2 is an illustration of a detailed construction of the above-mentioned transfer separation unit 5. This transfer separation unit 5 is equipped with an endless-form transfer material conveyance belt 501, and a drive roller 502, an electrode roller (conductive roller) 503 and a tension roller 504 which support the transfer material conveyance belt 501, a power source 505 which impresses an electric field for transfer on the electrode roller 503, etc. The electrode roller 503 is pressed on the photosensitive member 1 by resilient members 506 hooked at a shaft 503*a* of the roller 503, and a voltage of the power source 505 is impressed on the electrode roller 503 through a blade electrode 507 the fore end of which is in slidable contact with an electrode axis 503*b*. Numeral 508 denotes a cleaning member removing the toner on the surface of the transfer material conveyance belt 501 by a blade system, 509 a guide made of Mylar which is provided in a paper-feeding route and the fore end of which is in contact with the surface of the transfer material conveyance belt 501, and 510 and 511 guides for the conveyance of the transfer material 7.

In this transfer separation unit 5, an electric charge having the same polarity as a surface charge of the photosensitive member 1 and being higher than the latter is impressed on the electrode roller 503 by the power source 505 when the transfer material 7 proceeds between the transfer material conveyance belt 501 and the photosensitive member 1, in a state that it is held between them, and thereby the toner on the surface of the photosensitive member 1 is transferred onto the surface of the transfer material 7.

On the occasion, it is necessary to prevent the occurrence of charge injection to the transfer material 7 until the part of the transfer material conveyance belt 501 on which the charge has been given from the electrode roller 503 is detached from the photosensitive member 1. This is because a fault in detachment of the transfer material 7 occurs due to static electricity generated between the transfer material 7 and the photosensitive member 1 when the charge is injected into the transfer material 7.

It is necessary, besides, to damp the charge to a certain level by the time the transfer material conveyance belt 501 makes one round and comes again to the same position of the electrode roller 503. This is because if a charge in the polarity reverse to that of the electrode roller 503 remains on the surface of the transfer material conveyance belt 501 the following transfer after the transfer material conveyance belt 501 is detached from the transfer material 7 or the photosensitive member 1 is impeded.

In view of these necessities, a charge-holding time constant representing the process of time wherein the charge given by the electrode roller 503 transfers from the inside of the transfer material conveyance belt 501 to the outside thereof is suitably 0.01 to 10 sec. For this purpose, an electric resistance value of the transfer material conveyance belt 501 is set at $10^{10}$ Ωcm to $10^{13}$ Ωcm, or preferably about $10^{11}$ Ωcm, on the volume resistance value basis in the present embodiment.

As for the material of this transfer material conveyance belt 501, such characteristics are requisite that the belt is driven stably, that a change with time, such as permanent deformation, is little, that no chemical change takes place due to the contact with the photosensitive member 1, that the material has high dimensional precision, that it has excellent resistance to ozone, that the electric resistance value is controllable and the electric characteristic is stable, etc. A polymer film of polyurethane or the like or urethane rubber is suitable as a material to meet these requirements. The elasticity modulus of the material is suitably about 450 g/mm$^2$.

The surface treatment of the transfer material conveyance belt 501 is made in the following way. Since the toner on the photosensitive member 1 sticks on the part of this transfer material conveyance belt 501 other than the part thereof which bears the transfer material 7, said part needs to be cleaned by the cleaning member 508. In view of dimensions and simplicity in structure, in the present embodiment, a blade system is used for this cleaning member 508 as described above. Therefore the properties of the surface of the transfer material conveyance belt 501 need to be fitted for this cleaning system. In order to meet this necessity, the surface of the belt is made to be rough appropriately or coated with fluororubber, FLC or the like in the present embodiment.

Moreover, the thickness of the transfer material conveyance belt 501 is set in the following way. First, the voltage to be impressed on the electrode roller 503 needs to be proportional to the thickness substantially. This is because a large thickness of the transfer material conveyance belt 501 results in a small electrostatic capacity between the electrode roller 503 and the photosensitive member 1, which makes it impossible to give a sufficient charge to the transfer material conveyance belt 501. In the case when a rubber belt is employed, it is suitably 0.3 mm to 1 mm practically. If the thickness is smaller than the above, it causes such problems that the stability in manufacture is deteriorated and that the conveyance of the belt turns difficult. When a film is employed, a thickness of about 0.05 mm to 0.5 mm is practical.

Next, a description will be made on the material and the electric resistance value of the electrode roller 503. First, as to the material thereof, an electroconductive metal such as aluminum, stainless steel or iron is used. In the case when a high transferring electric field is needed for transfer of an image accompanied by a large quantity of sticking toner, however, an extraordinary discharge occurs between the transfer material conveyance belt 501 and the photosensitive member 1 and disturbs the image, which necessitates some contrivance. This discharge is caused supposedly by the rapid approach of the transfer material conveyance belt 501 to the photosensitive member 1 under a high voltage. The occurrence of said discharge can be prevented by covering the peripheral surface of the electrode roller 503 with urethane rubber having a resistance value of $10^5$ Ωcm to $10^{10}$ Ωcm and a thickness of about 5 mm, or the like, so that the electric field may not rise sharply. In the experiment, an excellent result was obtained with a resistance value of $10^9$ Ωcm. By setting the rubber hardness of this urethane rubber at 30° to 60°, besides, closeness in contact between the transfer material conveyance belt 501 and the photosensitive member 1 is improved and the occurrence of nonuniformity in transfer can be suppressed.

Next, a description will be made on a pressing force of the electrode roller 503 on the photosensitive member 1. This pressing force causes problems of the occurrence of the nonuniformity in transfer and the lowering of a transfer rate when it is weak, while it causes a tendency that characters accompanying a large quantity of sticking toner and slender lines are defaced when it is too strong to the contrary. An excellent result was obtained experimentally when said pressing force was 10 to 1500 gf/cm, and 54 gf/cm in particular.

The position of this pressing of the electrode roller 503 on the photosensitive member 1 has a large effect on the detachment of the transfer material 7 from the photosensitive member 1. In the belt-roller transfer system, the transfer material 7 is detached toward the one of smaller curvatures out of the photosensitive member 1 and the electrode roller 503 by the force of stiffness of its own. Therefore it is necessary to make the curvature of the transfer material conveyance belt 501 as small as possible. As shown in FIG. 2, in this embodiment, the pressing position of the electrode roller 503, i.e. a nip plane A whereon the transfer material conveyance belt 501 is pressed against the photosensitive member 1 by the electrode roller 503, is so set as to be located on the upstream side of a position B whereat the transfer material conveyance belt 501 is detached from the photosensitive member 1. In the experiment, an excellent result was obtained by setting a space between the downstream end of the nip plane A and the position B of to be about 2 to 4 mm.

Next, a description will be made on the drive roller 502. The material of this drive roller 502 is only conditioned on its precise machinability, and a solid metal roller, a rubber roller or the like can be cited as such.

Next, a description will be made on the cleaning member 508. Since the toner sticks on the surface of the transfer material conveyance belt 501, as described previously, stain on the back of the transfer material 7 and a fault in separation take place if the sticking toner is not removed. The blade system, a fur brush or the like can be used as the cleaning system, and in this embodiment, the blade system using the rubber blade 508*a* is adopted in consideration of making the device small in size, saving the space, reducing the cost, etc.

For preventing the transfer material conveyance belt 501 from moving aside, there are a method of providing a collar for the drive roller 502, the electrode roller 503 or the tension roller 504 and a method of providing a guide therefor, and by providing a collar having a height of about 4 mm, according to the experiment, an excellent performance could be obtained without damaging the belt.

On this transfer material conveyance belt 501, an electric charge remains at the time when it is detached from the photosensitive member 1, when the transfer material 7 is detached from the transfer material conveyance belt 501, etc. No particular elimination of the charge is needed when this transfer material conveyance belt 501 is made to have an appropriate time constant as described previously, but no proper transferring electric field can be formed in the following transfer without eliminating the charge when a belt having a high resistance value (i.e. large charge holding time constant) is employed. As to the transfer material as well, scattering of toner occurs when appropriate elimination of the charge is not conducted. While there are such countermeasures as a method of providing a charge-eliminating brush, a method of using an alternating-current corona discharge, etc., a method wherein the charge-eliminating brush is provided at a position (not shown in the figure) whereat the transfer material 7 is detached from the transfer material conveyance belt 501, or a method wherein the alternating-current corona discharge is applied from above the transfer material conveyance belt 501 and the transfer material 7 (not shown in the figure), is adopted as occasion demands in this embodiment.

Next, a description will be made on a method of driving the transfer material conveyance belt 501. A difference between a circumferential speed of the photosensitive member 1 and a moving speed of the transfer material conveyance belt 501 causes a problem as a change in the rate of longitudinal multiplication of a tarnsferred image. This change in the rate of multiplication is dependent on the speed of the belt. In order to correct this difference in the speed, accordingly, it is necessary to control the drive roller 502 with high precision, which produces such problems as a rise in the cost, the durability of the belt and the roller, etc. Since the transfer material conveyance belt 501 is pressed on the photosensitive member 1 by the electrode roller 503 in the present embodiment, a driving force is generated also on the electrode roller 503 side, and therefore the difference in the speed does not occur theoretically according to this driving. However, the presence of the load of the cleaning member 508 and others causes a slip, which becomes a problem. To cope with it, a coefficient of friction between the drive roller 502 and the transfer material conveyance belt 501 is set to be low a little, and the drive roller 502 is moved faster by about 0 to 1% in the moving speed than the belt so as to supplement the driving force by the electrode roller 503. By this means, the speed difference in question can be eliminated substantially.

Next, a voltage value of the power source 505 will be described. An optimum value of an impression voltage varies according to the quantity of the sticking toner, the thickness and electrical physical properties of the transfer material 7, the thickness and electrical physical properties of the transfer material conveyance belt 501, etc. Accordingly, it is necessary to decide a point of excellent balance on the basis of performance requirement, specifications and others of a machine. The switchover of the impression voltage is conducted by detecting the thickness and physical properties of the transfer mateiral 7, etc. by some means. When a manual paper-feeding mechanism is operated, a method of raising the voltage, or the like, can be thought of. In the present embodiment, the impression voltage is set at 3 KV in the case of cassette paper-feeding, while it is switched over to be high (at 4 KV) by a manual feeding signal in the case of the manual paper-feeding, since thick paper such as OHP or an envelope is fed mostly in this case. Besides, a current capacity is set to be 20 $\mu$A at the maximum. Of course, such contrivance as to vary the voltage by key-inputting to-print the thick paper by a user can be adopted as well.

In the case when the transfer material conveyance belt 501 is wound through an angle of 180 degrees around the electrode roller 503 without using the tension roller 504, zigzag crawling takes place when the transferring electric field to be impressed on the electrode roller 503 is increased. This crawling appears conspicuously in the former half of an image and less in the latter half thereof. The cause of this phenomenon lies supposedly in that an electric field sufficient for aerial discharge is formed in an area just in front of a place wherein the surface parts of the electrode roller 503 and the photosensitive member 1, both of which are rollers, are brought into contact with each other by rotations and the toner is charged therewith reversely. It is supposed that this discharge occurs actually between the transfer material 7 and the photosensitive member 1. As to the countermeasure therefor, it is only needed to change the passages of the transfer material conveyance belt 501 and the transfer material 7 and to set the same so as for a high electric field not to be formed just before transfer, that is, for the electric field not to rise sharply along the proceeding route of the transfer material 7, in addition to covering the surface of the electrode roller 503 with the urethane rubber or the like having the resistance value of $10^5$ Ωcm to $10^{10}$ Ωcm, as described previously.

For this purpose, the tension roller 504 is disposed on the side of the entry of the transfer material 7 of the electrode roller 503, in the present embodiment, so that the transfer material conveyance belt 501 proceeds to the electrode roller 503 and the photosensitive member 1 from the direction being near the peripheral surface of the electrode roller 503. Besides, the volume resistance value of the coating material applied for resistance to cleaning on the surface of the transfer material conveyance belt 501 is set at $10^9$ Ωcm or above and the guide 509 made of Mylar is provided in such a manner that the fore end thereof is in contact with the transfer material conveyance belt 501, as described previously, so as to prevent the direct contact of the transfer material 7 with the transfer material conveyance belt 501. Consequently, the occurrence of the crawling further lessens sharply.

EFFECT OF THE INVENTION

According to the present invention, as described above, the point whereat the transfer material conveyance belt is detached from the toner image retainer is set on the downstream side of the nip plane, and this produces an advantage that the detachment of the transfer material from the toner image retainer is conducted reliably.

What is claimed is:

1. An electrostatic recording apparatus comprising:

an image retainer for retaining a toner image;

a movable endless belt for conveying a transfer material to said image retainer, said belt having a separation point at which said belt separates from said image retainer;

a belt drive roller arranged on a downstream side of said belt, said belt drive roller moving said belt in a direction substantially tangent to said image retainer at said separation point; and an electrode roller for applying an electric voltage to said belt, and for pressing said belt onto said image retainer, thereby forming a nip portion between said electrode roller and said image retainer along a nip plane having a downstream end, said toner image being transferred onto said transfer material while said transfer material passes through said nip portion;

said belt and said roller being arranged whereby said separation point is 2 to 4 mm from said downstream end.

* * * * *